US005970960A

United States Patent [19]

Azuma

[11] Patent Number: 5,970,960

[45] Date of Patent: Oct. 26, 1999

[54] EXHAUST GAS RECIRCULATION SYSTEM OF INTERNAL COMBUSTION ENGINE

[75] Inventor: Satoshi Azuma, Kanagawa, Japan

[73] Assignee: Nissan Motor Co., Ltd., Kanagawa, Japan

[21] Appl. No.: 08/931,497

[22] Filed: Sep. 16, 1997

[30] Foreign Application Priority Data

Sep. 18, 1996 [JP] Japan ..... 8-245793
Sep. 18, 1996 [JP] Japan ..... 8-245794

[51] Int. Cl.[6] ..... F02M 25/06; F02M 35/10

[52] U.S. Cl. ..... 123/568.12; 123/568.17

[58] Field of Search ..... 123/568.11, 568.12, 123/568.17, 41.31

[56] References Cited

U.S. PATENT DOCUMENTS

| | | | |
|---|---|---|---|
| 4,134,377 | 1/1979 | Bamsey et al. | 123/568.12 |
| 4,267,812 | 5/1981 | Aula et al. | 123/568.12 |
| 4,397,275 | 8/1983 | Itoh et al. | 123/339 |
| 4,463,709 | 8/1984 | Pluequet | 123/41.31 |
| 4,741,295 | 5/1988 | Hosoya et al. | 123/568.17 |
| 5,433,183 | 7/1995 | Vansnick | 123/568.11 |
| 5,492,104 | 2/1996 | Elder et al. | 123/568.11 |
| 5,542,711 | 8/1996 | Vaudry | 123/568.12 |
| 5,666,930 | 9/1997 | Elder | 123/568 |
| 5,669,364 | 9/1997 | Everingham | 123/568 |

FOREIGN PATENT DOCUMENTS

| | | |
|---|---|---|
| 0816666A2 | 1/1998 | European Pat. Off. . |
| 63-164554 | 10/1988 | Japan . |
| 1-102465 | 7/1989 | Japan . |
| 5-256217 | 10/1993 | Japan . |
| 6-101587 | 4/1994 | Japan . |
| 2 062749A | 5/1981 | United Kingdom . |
| 2136945A | 9/1984 | United Kingdom . |

OTHER PUBLICATIONS

Combined Search and Examination Report Under Sections 17 and 18(3) GB9719921.0 Dec. 4, 1997.

Anonymous, "Exhaust Gas Recirculation Device", Research Disclosure 327113, Jul. 1991/549.

*Primary Examiner*—Tony M. Argenbright
*Assistant Examiner*—Arnold Castro
*Attorney, Agent, or Firm*—McDermott, Will & Emery

[57] ABSTRACT

To protect a plastic intake manifold of an internal combstion engine from heat possessed by exhaust gas recirculation gas, a cooling device is arranged between the plastic intake manifold and an exhaust gas recirculation valve. The cooling device cools the exhaust gas recirculation gas by means of a coolant. A gas discharge part of the cooling device constitutes a pipe portion which penetrates through an exhaust gas inlet hole of the intake manifold keeping a given space between an outer wall of the pipe portion and an inner wall of the exhaust gas inlet hole. The pipe portion may be a leading end portion of an exhaust gas recirculation pipe extending from an exhaust system of the engine.

9 Claims, 7 Drawing Sheets

EXHAUST GAS RECIRCULATION SYSTEM OF INTERNAL COMBUSTION ENGINE

The contents of patent application Ser. Nos. 8-245793 and 8-245794, with a filing date of Sept. 18, 1996 in Japan, are hereby incorporated by reference.

BACKGROUND OF THE INVENTION

1. Field of the Invention

The present invention relates in general to emission control systems for an internal combustion engine, and particularly to an exhaust gas recirculation (EGR) system of the engine. More specifically, the present invention relates to an improvement in connecting an EGR valve or an EGR pipe to a plastic intake manifold of an internal combustion engine.

2. Description of the Prior Art

Hitherto, in motor vehicles powered by an internal combustion engine, an exhaust gas recirculation (EGR) system has been commonly installed for reducing NOx emissions produced by the engine. As is known, the EGR system is designed to recirculate a metered amount of exhaust gas into the air-fuel mixture in the combustion chambers to reduce the temperature in the combustion chambers and thus NOx emissions. In the EGR systems, an EGR valve is installed in an EGR passage for regulating the amount of EGR. Usually, the EGR valve is connected to an intake manifold of the engine. Under operation of the EGR system, the EGR valve which is constructed of a metal is highly heated by absorbing heat of the recirculating exhaust gas.

Thus, if the intake manifold is constructed of a plastic (viz., glass fiber-reinforced plastic) for reducing the weight of the engine system or for other reasons, it is necessary to take any measure for protecting the plastic intake manifold from the heat of the EGR valve.

Hitherto, various measures have been proposed and put into practical use for protection of the plastic intake manifold from the heat of the EGR valve, some of which are shown in Japanese Patent First Provisional Publications 5-256217 and 6-101587 and Japanese Utility Model First Provisional Publication 63-164554. In the Publication 5-256217, the EGR valve is mounted to the plastic intake manifold through a mounting bracket of corrugated stainless steel plate. In the Publication 6-101587, the EGR valve is connected to the plastic intake manifold with an interposal of a heat insulator therebetween, first bolts are used to secure the heat insulator to the manifold and second bolts are used to secure the valve to the heat insulator. In the publication 63-164554, a junction portion between the EGR valve and the plastic intake manifold is formed with an annular groove through which a coolant flows for cooling the junction portion.

In addition to the above-mentioned measures, a measure for protection of the plastic intake manifold from the heat of exhaust gas is described in Japanese Utility Model First Provisional Publication 1-102465. In this measure, a fresh air from an air cleaner is fed into an EGR pipe to reduce the temperature of the EGR gas led into the plastic intake manifold. Furthermore, for suppressing or minimizing direct contact of the highly heated exhaust gas with an inner wall of the plastic intake manifold, a leading end of the EGR pipe is projected into the interior of the intake manifold through a pipe passing opening formed in the same.

SUMMARY OF THE INVENTION

It is therefore an object of the present invention to provide an exhaust gas recirculation system of an internal combustion engine, which is provided in view of the disclosure of the above-mentioned publications.

According to a first aspect of the present invention, there is provided an exhaust gas recirculation system for use with an internal combustion engine having a plastic intake passage. The system comprises a connecting base formed on the plastic intake passage, the connecting base having an exhaust gas inlet hole connected with the interior of the intake passage; an exhaust gas recirculation valve through which a metered amount of exhaust gas produced by the engine is fed back to the interior of the plastic intake passage; and a cooling device arranged between the connecting base and the exhaust gas recirculation valve, the cooling device including mutually separated first and second passages, the first passage connecting an outlet opening of the exhaust gas recirculation valve to the exhaust gas inlet hole of said connecting base, the second passage being shaped to surround the first passage and adapted to flow therein a coolant. The first passage of the cooling device includes a pipe portion which penetrates through the exhaust gas inlet hole keeping a given space between an outer wall of the pipe portion and an inner wall of the exhaust gas inlet hole.

According to a second aspect of the present invention, there is provided an exhaust gas recirculation system for use with an internal combustion engine having a plastic intake passage. The system includes a connecting base formed on the plastic intake passage, the connecting base having an exhaust gas inlet hole connected with the interior of the intake passage; an exhaust gas recirculation valve through which a metered amount of exhaust gas produced by the engine is fed back to the interior of the plastic intake passage; and an exhaust gas recirculation pipe having first and second end portions, the first end portion penetrating through the exhaust gas inlet hole and the second end portion being connected to an outlet opening of the exhaust gas recirculation valve. An opening defined by an inner end of the exhaust gas inlet hole is larger than that defined by the other portion of the exhaust gas inlet hole.

According to a third aspect of the present invention, there is provided a cooling device for use in an exhaust gas recirculation system. The device comprises a front housing member; a rear housing member; a seal member; and bolts for coupling the front and rear housing members having the seal member interposed therebetween thereby to constitute a housing unit. The housing unit includes mutually separated first and second passages, the first passage being adapted to pass therethrough exhaust gas for the exhaust gas recirculation, the second passage being shaped to surround the first passage and adapted to flow therethrough a coolant.

DETAILED DESCRIPTION OF THE EMBODIMENTS

Figure 1:
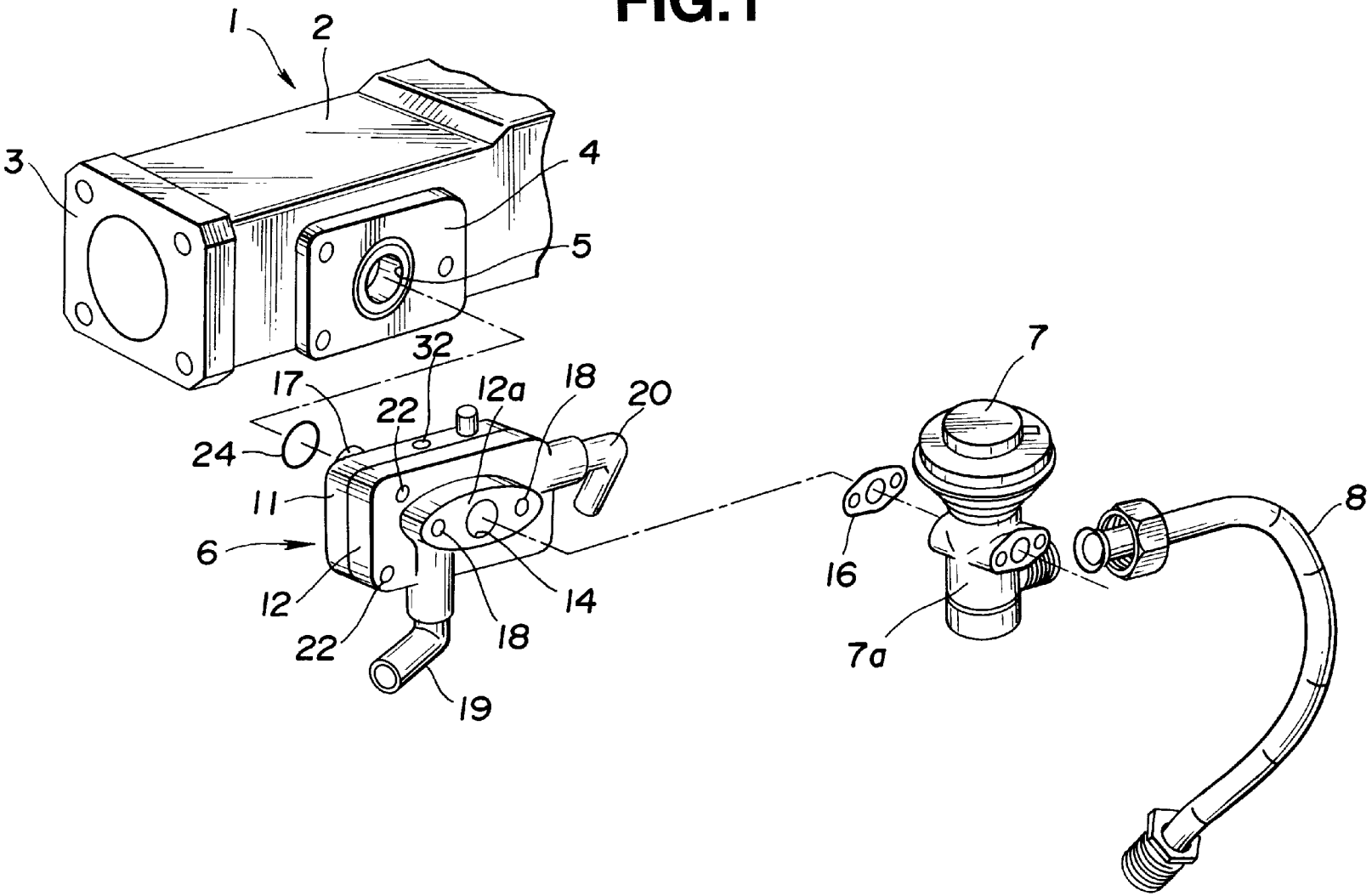
FIG. 1 is an exploded view of an essential portion of an exhaust gas recirculation system which is a first embodiment of the present invention.

Referring to FIGS. 1 to 5, particularly FIG. 1, there is shown an exhaust gas recirculation (or EGR) system which is a first embodiment of the present invention.

In FIG. 1, denoted by numeral 1 is a plastic intake manifold which is secured to a cylinder head (not shown) of an internal combustion engine in a known manner. The intake manifold 1 generally comprises an elongated collector portion 2 which extends along the row of engine cylinders (not shown), a plurality of branches (not shown) which extend from one side of the collector portion 2 to respective intake ports of the cylinder head and an inlet flange 3 which is formed on an upstream end of the collector portion 2 to mount thereto a throttle chamber (not shown). The entire structure of the plastic intake manifold 1 may be well understood when referring to FIG. 6. The intake manifold 1 is molded from glass fiber-reinforced Nylon-6, 6 or the like.

As is seen from FIG. 1, the collector portion 2 is integrally formed near the inlet flange 3 with a mounting seat 4 which is rectangular in shape. The mounting seat 4 has at a center thereof a cylindrical hole 5 connected with the interior of the collector portion 2.

To the mounting seat 4, there is fixed a cooling housing 6 of metal. To the cooling housing 6, there is connected an EGR valve 7 which is of a diaphragm type. One end of an EGR pipe 8 is connected to the EGR valve 7 and the other end of the EGR pipe 8 is connected to an exhaust manifold (not shown) of the engine, so that part of exhaust gas in the exhaust manifold is led to the EGR valve 7 through the EGR pipe 8.

The cooling housing 6 is constructed of an aluminum die-cast. The cooling housing 6 comprises generally a rear housing member 11 which is placed on the mounting seat 4 of the intake manifold 1 and a front housing member 12 to which the EGR valve 7 is connected. As is seen from FIGS. 3 and 4, these two housing members 11 and 12 are united through three bolts 13 with an interposal of a seal member 34 therebetween. The seal member 34 may be a liquid gasket or the like.

Figure 3:
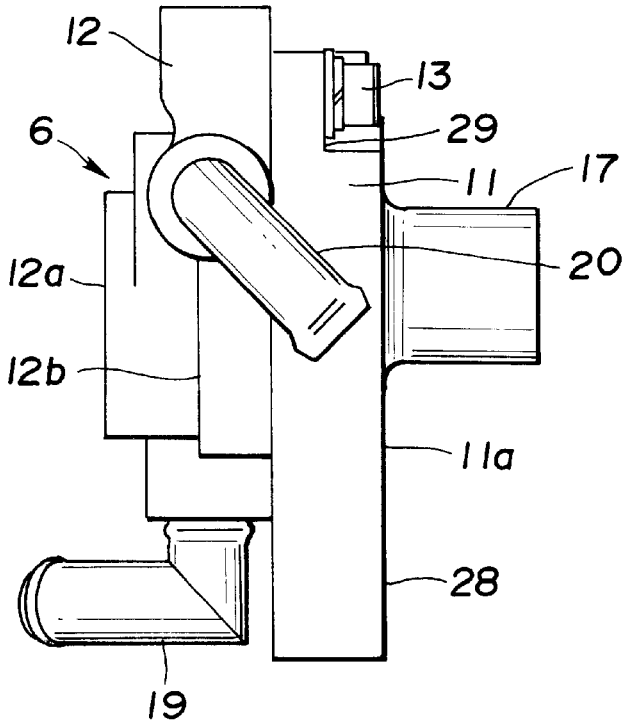
FIG. 3 is a side view of the cooling housing.

As is seen from FIG. 3, the rear housing member 11 has at a rear side thereof a flat contact surface 11*a* which is intimately put on the above-mentioned mounting seat 4, and as is seen is from FIGS. 1 and 3, the front housing member 12 has at a front side thereof a flat contact surface 12*a* to which a body 7*a* of the EGR valve 7 is mounted through a gasket 16 (see FIG. 1). The flat contact surface 12*a* is raised from a major flat portion 12*b* of the front side of the front housing member 12.

Figure 4:
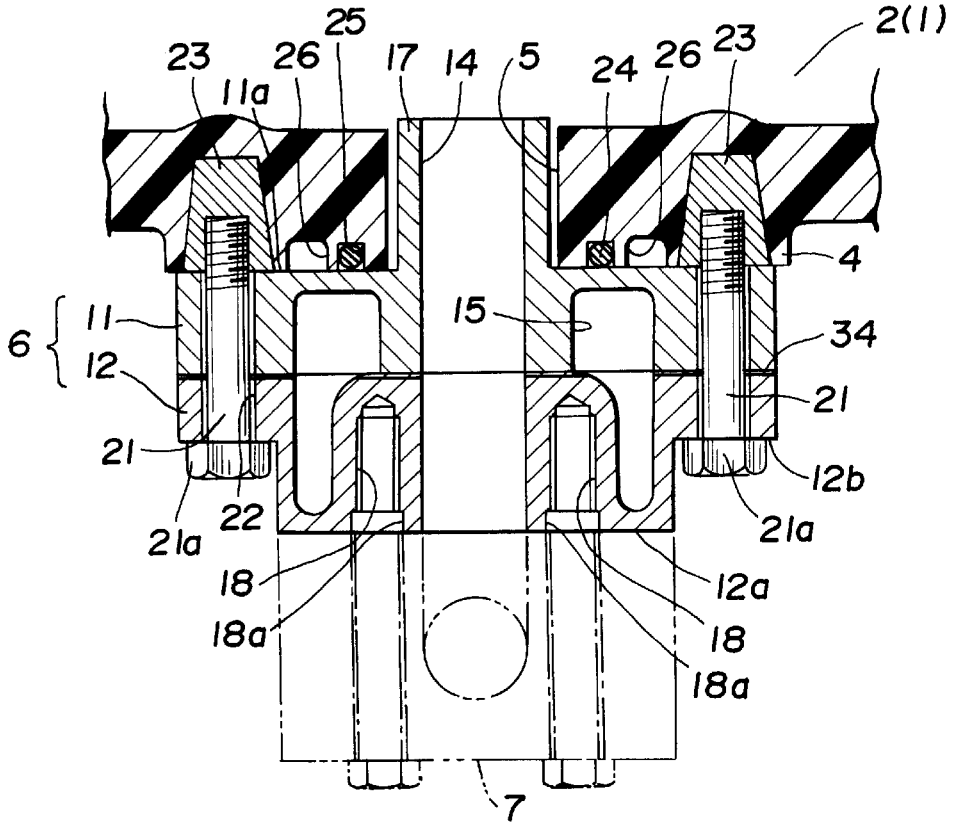
FIG. 4 is a sectional view of the cooling housing connected to a plastic intake manifold.

As is best seen from FIG. 4, the cooling housing 6 has therein an exhaust gas passage 14 which straightly passes through the front and rear housing members 12 and 11. The exhaust gas passage 14 is enclosed or surrounded by a water jacket 15 defined in the cooling housing 6. As will be described in detail hereinafter, in the water jacket 15, there flows cooling water.

As is seen from FIG. 1, a front end of the exhaust gas passage 14 is exposed to the flat contact surface 12*a* and connected to an outlet port of the EGR valve 7. While, as is seen from FIG. 4, a rear end of the exhaust gas passage 14 is defined by an integral pipe portion 17 which is projected from the flat contact surface 11*a*. The outer diameter of the pipe portion 17 is slightly smaller than the diameter of the cylindrical hole 5 of the mounting seat 4 of the intake manifold 1. Upon assembly, the pipe portion 17 is received in the cylindrical hole 5 leaving a small annular clearance therebetween. Preferably, the clearance is about 1 mm to 2 mm in thickness. With the clearance, a certain heat insulation is obtained. If desired, a separate pipe member of metal (such as stainless steel or the like) may be used in place of the integral pipe portion 17. In this case, the separate pipe member is press-fitted into the exhaust gas passage 14 of the cooling housing 6.

Figure 2:
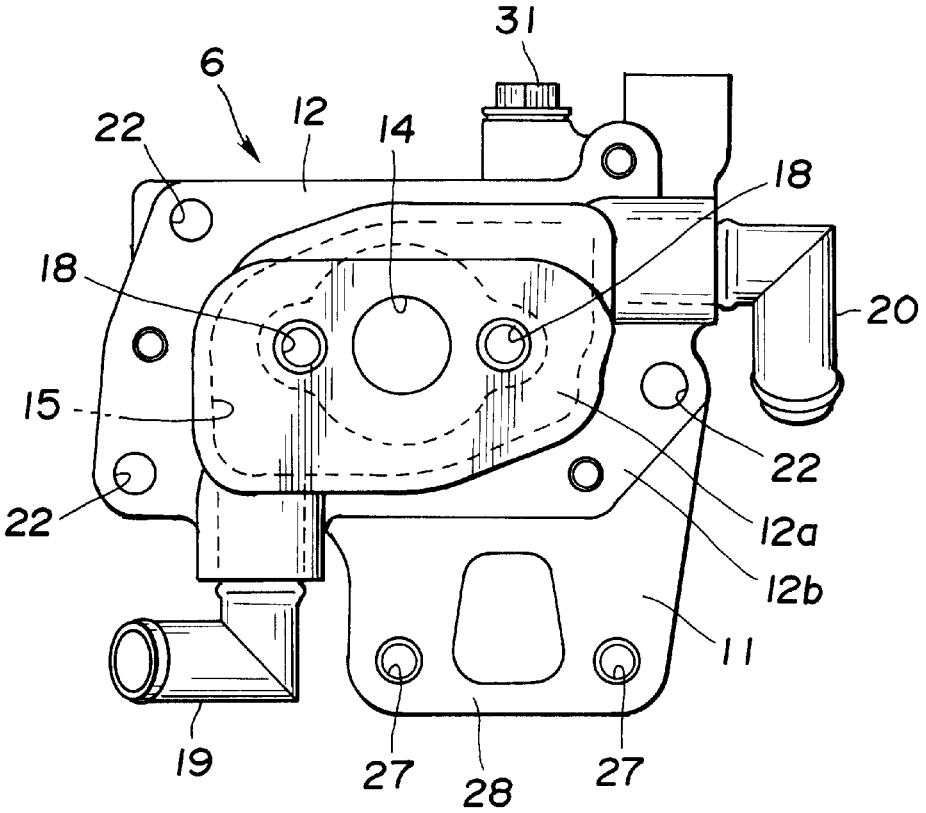
FIG. 2 is a front view of a cooling housing installed in the first embodiment.

As is well seen from FIGS. 1 and 2, the flat contact surface 12*a* of the front housing member 12 is formed at both sides of the exhaust gas passage 14 with threaded bolt holes 18.

As will be seen from FIG. 4, two threaded bolts extending from the EGR valve 7 are engaged with the bolt holes 18 for securing the EGR valve 7 to the flat contact surface 12*a*.

As is seen from FIG. 4, each bolt hole 18 extends in the direction of the thickness of the front housing member 12 and has a counter bore part 18*a* at an open side thereof. As shown, each bolt hole 18 is formed in a boss portion whose outer surface is exposed to the water jacket 15. The length of the counter bore part 18*a* of each bolt hole 18 is equal to or greater than the thickness of a wall of the water jacket 15, that is, the distance from the flat contact surface 12*a* to the water jacket 15. In the illustrated embodiment, the length of the counter bore part 18*a* is equal to the thickness of the wall of the water jacket 15. This means that the threaded part of each bolt hole 18 is entirely surrounded or enclosed by the water jacket 15. As will become apparent as the description proceeds, this entire enclosure by the water jacket 15 brings about an assured cooling of the boss portions for the bolt holes 18. Due to provision of the counter bore part 18*a*, the actually engaged portion of the bolt with the threaded part of each bolt hole 18 is positioned closer to the water jacket 15 and thus effectively cooled by the cooling water in the water jacket 15. Thus, undesired looseness of the bolt is suppressed.

As is seen from FIGS. 1 to 3, the front housing member 12 is provided at a lower portion thereof with an inlet pipe 19 and at a side portion thereof with an outlet pipe 20, these pipes 19 and 20 being connected to the water jacket 15 in the cooling housing 6. Although not shown in the drawings, water pipes are connected to the inlet and outlet pipes 19 and 20, so that part of engine cooling water driven by a water pump (not shown) is forced to flow in the water jacket 15.

As is understood from FIGS. 1, 2 and 4, the cooling housing 6 is provided with three through bolt holes 22 each extending through both the front and rear housing members 12 and 11. Each bolt hole 22 has a front end exposed to the major flat portion 12*b* of the front housing member 12.

As is understood from FIG. 4, threaded bolts 21 pass through respective through bolt holes 22 and engage with respective metal nuts 23 embedded in the mounting seat 4 of the intake manifold 1. With this, the cooling housing 6 is tightly secured to the mounting seat 4 of the intake manifold 1. Each bolt 21 has an enlarged head 21*a* seated on the major flat portion 12*b* of the front side of the front housing member 12. As shown, each nut 23 has a trapezoidal cross section to increase an area which intimately contacts with the rear housing member 11. If desired, stud bolts extending from the mounting seat 4 may be used in place of the above-mentioned threaded bolts 21. That is, in this case, each stud bolt passes through the bolt hole 22 and engages with a nut placed on the major flat portion 12*b*.

Between the mounting seat 4 and the rear housing member 11, there is disposed a seal ring 24 which is held in an annular groove 25 formed in the mounting seat 4. The mounting seat 4 has around the groove 25 a heat insulation groove 26. That is, the heat insulation groove 26 effects a heat insulation between the cooling housing 6 and the intake manifold 1.

Figure 5:
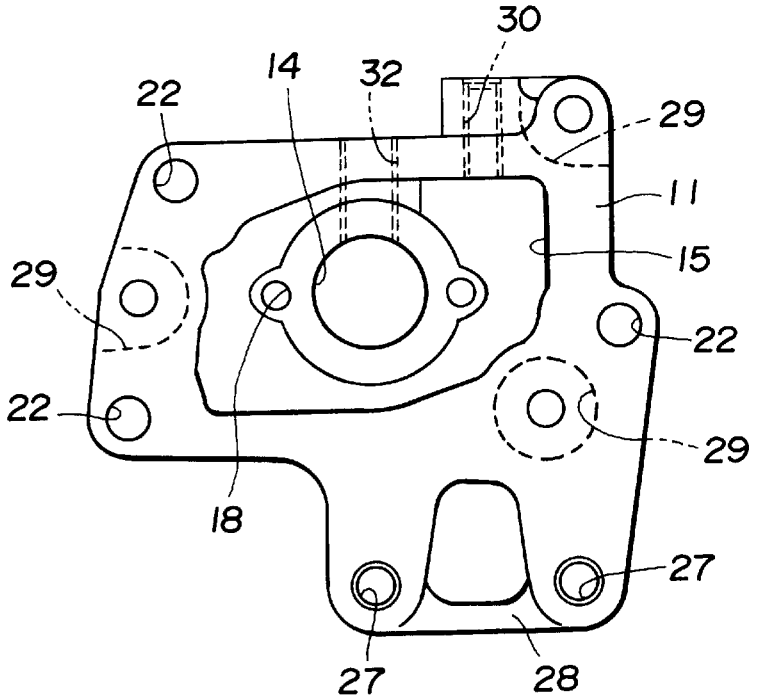
FIG. 5 is a front view of a rear housing member of the cooling housing.

As is seen from FIGS. 2 and 5, the rear housing member 11 of the cooling housing 6 is integrally formed at a lower part thereof with a bracket portion 28 which has a pair of threaded bolt holes 27.

As is understood from FIGS. 3 and 5, the rear side of the rear housing member 11 has three depressions 29 which receive heads of the above-mentioned bolts 13 by which the rear and front housing members 11 and 12 are united.

As is seen from FIGS. 1 and 5, the rear housing member 11 is formed with an air discharging threaded hole 30 which is communicated with the water jacket 15. The air discharging hole 30 is closed by an air discharging plug 31 (see FIG. 2) detachably engaged therewith.

As is seen from FIG. 5, the rear housing member 11 is formed near the air discharging hole 30 with a sensor mounting bore 32 which is exposed to the exhaust gas passage 14. Although not shown in the drawing, a temperature sensor is received in the bore 32 for sensing the temperature of EGR gas flowing in the exhaust gas passage 14.

Under operation of the associated engine, part of exhaust gas in the exhaust manifold is led into the plastic intake manifold 1 through the above-mentioned EGR system for reducing NOx emissions. Due to operation of the EGR valve 7, the amount of EGR gas led into the intake manifold is adjusted.

It is now to be noted that during operation of the EGR system, part of cooling water driven by the water pump of the engine is forced to flow in the water jacket 15 in the cooling housing 6.

In the following, advantages possessed by the EGR system of the first embodiment will be described.

First, the cooling housing 6 is effectively cooled by the cooling water. Thus, the amount of heat transmitted from the highly heated EGR valve 7 to the plastic intake manifold 1 is greatly reduced.

Second, due to provision of the pipe portion 17 (see FIG. 4) through which exhaust gas is led into the interior of the plastic intake manifold, it does not occur that the highly heated exhaust gas directly blows on the wall of the cylindrical hole 5 of the of the intake manifold 1.

Third, since the threaded part of each bolt hole 18 (see FIG. 4) is entirely enclosed by the water jacket 15, the threaded part is effectively cooled. Thus, undesired thermal deformation of the threaded part is suppressed, and thus undesired looseness of the corresponding bolt by which the EGR valve 7 is secured to the cooling housing 6 is suppressed or at least minimized.

Fourth, as is seen from FIG. 4, due to provision of a gap between the flat contact surface 12*a* and the major flat portion 12*b* of the front housing member 12, the heat transferring pass from the EGR valve 7 to the bolts 21 is substantially increased. Accordingly, the heat transmission to the plastic intake manifold 1 through the bolts 21 is minimized. Cooling effect applied to the bolts 21 from cooling water in the water jacket 15 promotes the minimization of heat transmission to the plastic intake manifold 1.

Fifth, due to provision of the seal member 34 interposed between the front and rear housing members 12 and 11, heat transmission through the cooling housing 6 is obstructed by a certain degree. The split construction of the cooling housing 6 simplifies formation of the water jacket 15.

Figure 6:
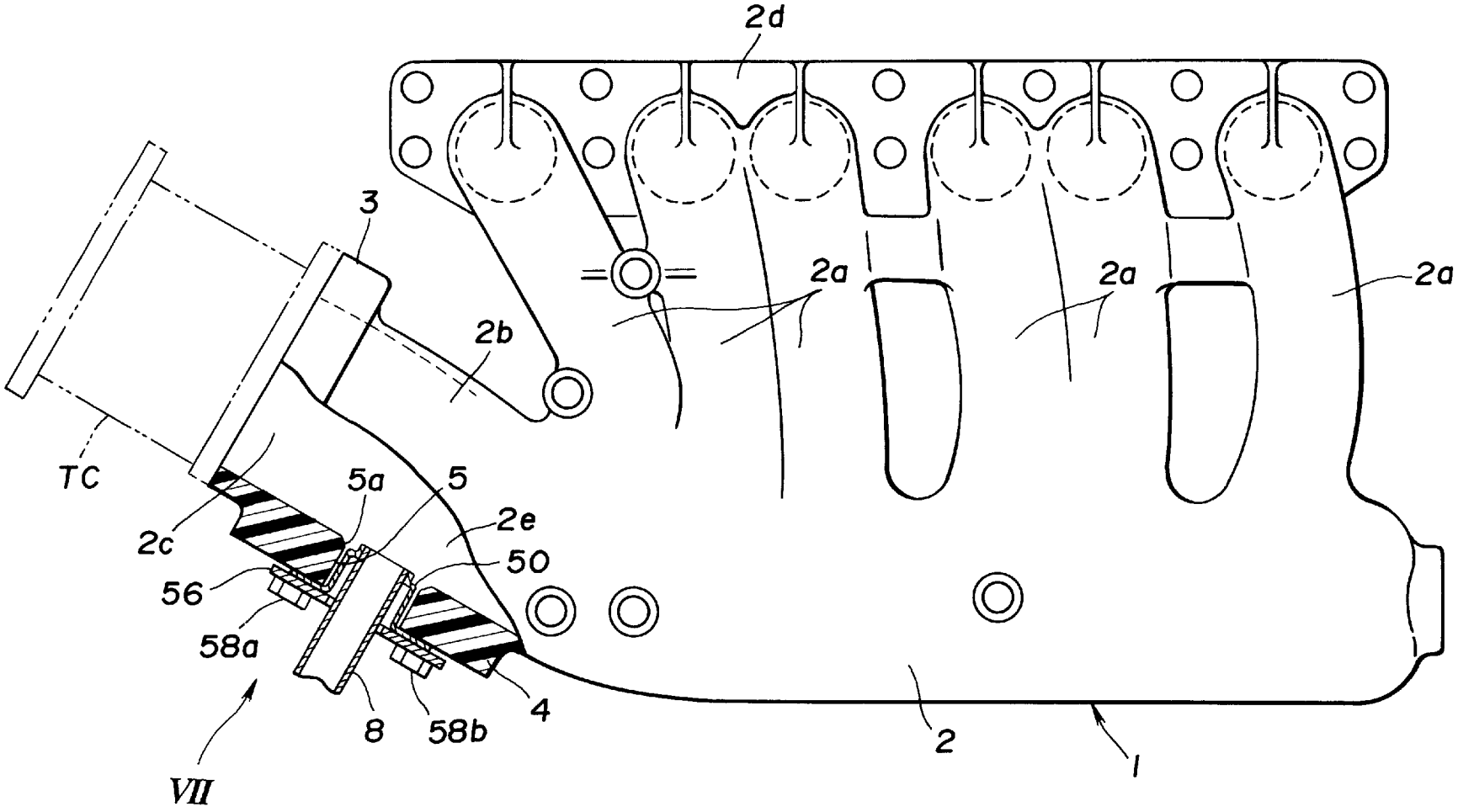
FIG. 6 is a partially cut plan view of a plastic intake manifold to which an exhaust gas recirculation system of a second embodiment of the present invention is practically applied.

Referring to FIGS. 6 to 10, particularly FIG. 6, there is shown an EGR system which is a second embodiment of the present invention.

In FIG. 6, there is shown a plastic intake manifold 1 designed for an in-line 6 cylinder internal combustion engine (not shown), to which the second embodiment is practically applied. Like in the above-mentioned first embodiment, the intake manifold 1 is molded from a fiber-reinforced plastic material such as those described in the section of the first embodiment.

Similar to the case of the first embodiment of FIG. 1, the plastic intake manifold 1 to which the second embodiment is applied comprises generally an elongated collector portion 2 which extends along the row of the engine cylinders, six branches 2*a* which extend from one side of the collector portion 2 to respective intake ports of the cylinder head, an inlet portion 2*b* which defines an upstream part of the collector portion 2 and an inlet flange 3 which is integrally formed on the inlet portion 2*b* to mount thereto a throttle chamber "TC". Denoted by numeral 2*c* is a circular inlet opening defined in the inlet flange 3, which thus connects the interior of the inlet portion 2*b* and the throttle chamber "TC". The branches 2*a* have at their leading ends an integral mounting flange 2*d* which is bolted to the cylinder head.

The inlet portion 2*b* has therein a passage 2*e* whose sectional area is substantially the same throughout the length thereof. The sectional form of the passage 2*e* gradually changes from a circle to a flat rectangular as a position moves from the inlet flange 3 to the collector portion 2.

As is seen from FIG. 6, the inlet portion 2*b* of the intake manifold 1 is integrally formed with a mounting seat 4 which is slightly raised. The mounting seat 4 has at a center thereof a cylindrical hole 5 connected with the interior of the inlet portion 2*b*. The cylindrical hole 5 extends in a direction perpendicular to a direction in which intake air in the inlet portion 2*b* flows.

Into the cylindrical hole 5, there is inserted a leading end 8*a* of an EGR pipe 8. The other end of the EGR pipe 8 is connected to an exhaust manifold (not shown) of the engine, so that part of exhaust gas in the exhaust manifold is led into the inlet portion 2*b* through the EGR pipe 8. Although not shown in the drawing, the EGR pipe 8 has an EGR valve operatively connected thereto.

Figure 7:
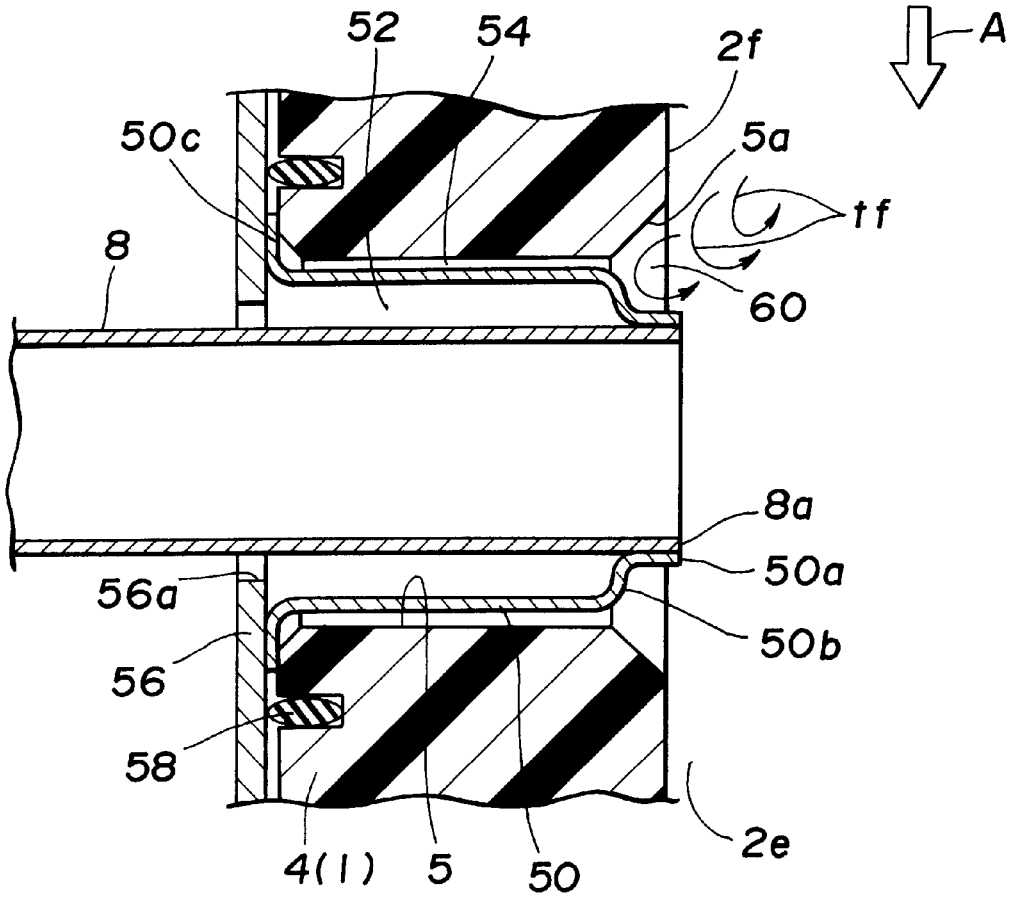
FIG. 7 is an enlarged sectional view of a portion indicated by an arrow "VII" of FIG. 6.

FIG. 7 shows in detail a mounting structure through which the leading end 8*a* of the EGR pipe 8 is tightly supported in the cylindrical hole 5 of the intake manifold 1. As shown in the drawing, within the cylindrical hole 5, there is disposed a collar member 50 of metal which surrounds the leading end portion of the EGR pipe 8 to define therebetween a certain annular clearance 52. The outer diameter of the collar member 50 is slightly smaller than the diameter of the cylindrical hole 5 thereby to define therebetween an annular clearance 54. The collar member 50 has a diametrically reduced front end 50*a* intimately disposed on and welded to the leading end 8*a* of the EGR pipe 8. Designated by numeral 50*b* is a stepped portion through which the reduced front end 50*a* is connected to a major portion of the collar member 50. As shown, the leading end 8*a* of the EGR pipe 8 and that of the reduced front end 50*a* are flush with each other. The collar member 50 has at a rear end thereof a radially outwardly extending flange 50*c* which is welded to a mounting plate 56. The mounting plate 56 is formed with a circular opening 56*a* through which the EGR pipe 8 passes. As shown, the diameter of the circular opening 56*a* is larger than that of the EGR pipe 8 thereby to define therebetween an annular gap. Due to provision of this annular gap, the annular clearance 52 defined between the EGR pipe 8 and the collar member 54 is communicated with the open air.

As is seen from FIG. 6, the mounting plate 56 is secured to the mounting seat 4 of the intake manifold 1 by means of two threaded bolts 58*a* and 58*b*.

Referring back to FIG. 7, the flange 50*c* of the collar member 50 is thus intimately put between the mounting seat 4 and the mounting plate 56. A seal ring 58 is disposed between the mounting seat 4 and the mounting plate 56 to isolate the annular gap 54.

As is seen from FIGS. 6 and 7, upon assembly, the leading end 8*a* of the EGR pipe 8 is slightly projected into the interior of the inlet portion 2*b* beyond an inner wall 2*f* of the inlet portion 2*b*.

As is seen from FIG. 7, the cylindrical hole 5 has a chamfered inner end 5*a* which surrounds the reduced front end 50*a* of the collar member 50. Thus, an annular groove 60 is formed around the reduced front end 50*a* of the collar member 50, which has a generally trapezoidal cross section, as shown. That is, in the illustrated example, the annular groove 60 is substantially defined by the chamfered inner end 5*a*, the stepped portion 50*b* of the collar member 50 and the reduced front end 50*a* of the same. However, if desired, the annular groove 60 may take various shapes other than the above-mentioned one, which are, for example, a shape having a semi-circular cross section, a shape having a rectangular cross section, a shape having a zigzag cross section, etc.,.

Figure 8:
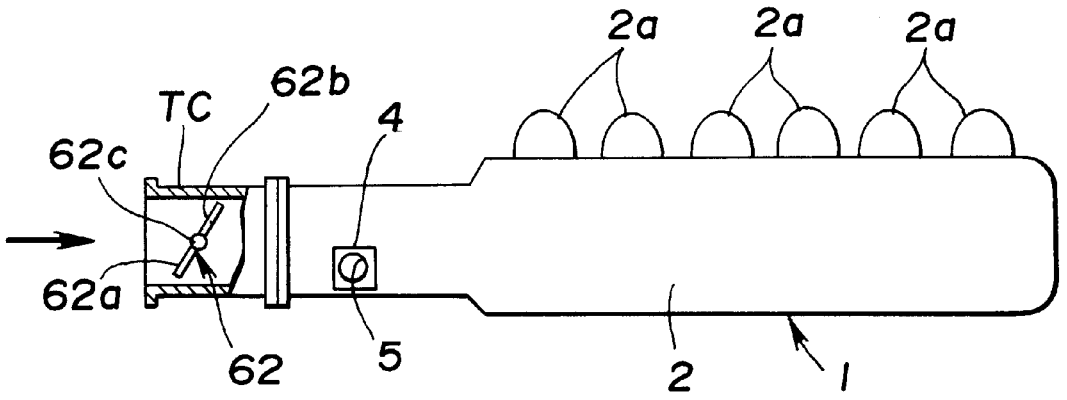
FIG. 8 is an illustration showing a positional relation between a throttle valve and a pipe inserting opening formed in the plastic intake manifold.
Figure 11:
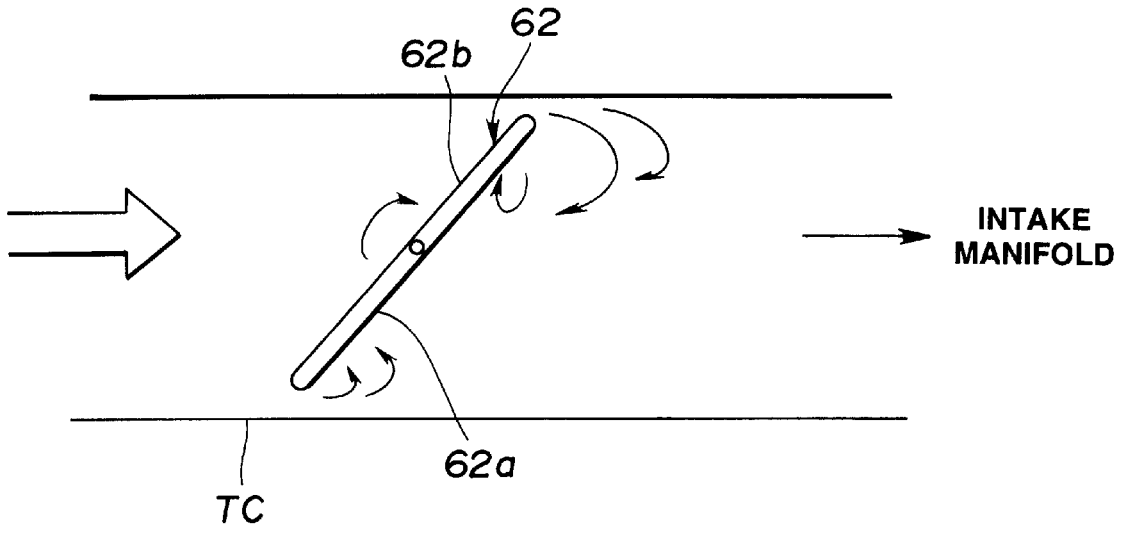
FIG. 11 is an illustration showing vortexes produced by a throttle valve of a throttle chamber.

FIG. 8 shows a positional relation between a throttle valve 62 in the throttle chamber "TC" and the cylindrical hole 5 of the mounting seat 4. As is understood from this drawing, the throttle valve 62 is of a butterfly valve type which comprises two wings 62*a* and 62*b* and a pivot shaft 62*c* about which the wings 62*a* and 62*b* pivot. In the illustrated example, the two wings 62*a* and 62*b* are arranged to pivot clockwise by a certain angle from the illustrated position upon need of opening the valve 62. That is, upon this need, the wing 62*a* moves upstream and the other wing 62*b* moves downstream. It is to be noted that assuming that the wings 62*a* and 62*b* are arranged in the above-mentioned manner, the cylindrical hole 5 is positioned at a position downstream of the wing 62*a*. In other words, the cylindrical hole 5 is positioned downstream of one of the wings 62*a* and 62*b* which moves upstream during opening operation of the valve 62. This is because such positioning provides the cylindrical hole 5 with a greater suction effect. In fact, as is seen from FIG. 11, since the vortexes produced behind the upwardly moving wing 62*a* are less than those produced behind the downwardly moving wing 62*b*, larger air flow is obtained in the downstream position of the wing 62*a*.

In the following, advantages possessed by the EGR system of the second embodiment will be described.

First, due to provision of the collar member 50 in the cylindrical hole 5 of the intake manifold 1, the inner wall of the cylindrical hole 5 is effectively protected from the heat radiated from the EGR pipe 8. That is, due to presence of the collar member 50, two annular clearances 52 and 54 are defined between the inner wall of the cylindrical hole 5 and the EGR pipe 8, the clearances 52 and 54 serving as excellent heat insulating means. Thus, undesired thermal deformation of the inner wall of the cylindrical hole 5 is suppressed or at least minimized.

Second, due to provision of the annular groove 60 (see FIG. 7), the chamfered inner end 5*a* of the cylindrical hole 5 is effectively protected from the heat radiated from the reduced front end 50*a* of the collar member 50. In fact, the reduced front end 50*a* is heated very high because it is welded to the EGR pipe 8. Provision of the chamfered inner end 5*a* can avoid formation of a sharpen edge of the cylindrical hole 5 where heat is collected. As is understood from FIG. 7, under flowing of air along the inner wall 2*f* in the direction of the arrow "A", turbulent flows are produced near the annular groove 60 as is indicated by arrows "tf", which can absorb heat from the wall of the groove 60 and the reduced front end 50*a* of the collar member 50.

Third, since the leading end 8*a* of the EGR pipe 8 is projected into the interior of the intake manifold 1, EGR gas discharged from the end 8*a* instantly and easily mixes with intake air flowing in the intake manifold 1. The highly heated exhaust gas is suppressed from directly blowing on the inner wall 2*f* of the plastic intake manifold 1. If, as is described hereinabove, the cylindrical hole 5 is positioned downstream of the wing 62*a* which moves upstream during opening operation of the throttle valve 62, larger intake air flow is obtained in the area where the leading end 8*a* of the EGR pipe 8 is exposed. This promotes not only the cooling effect applied to the wall of the groove 60 by the turbulent flows "tf" but also the mixing of EGR gas and intake air in the intake manifold 1.

Figure 9:
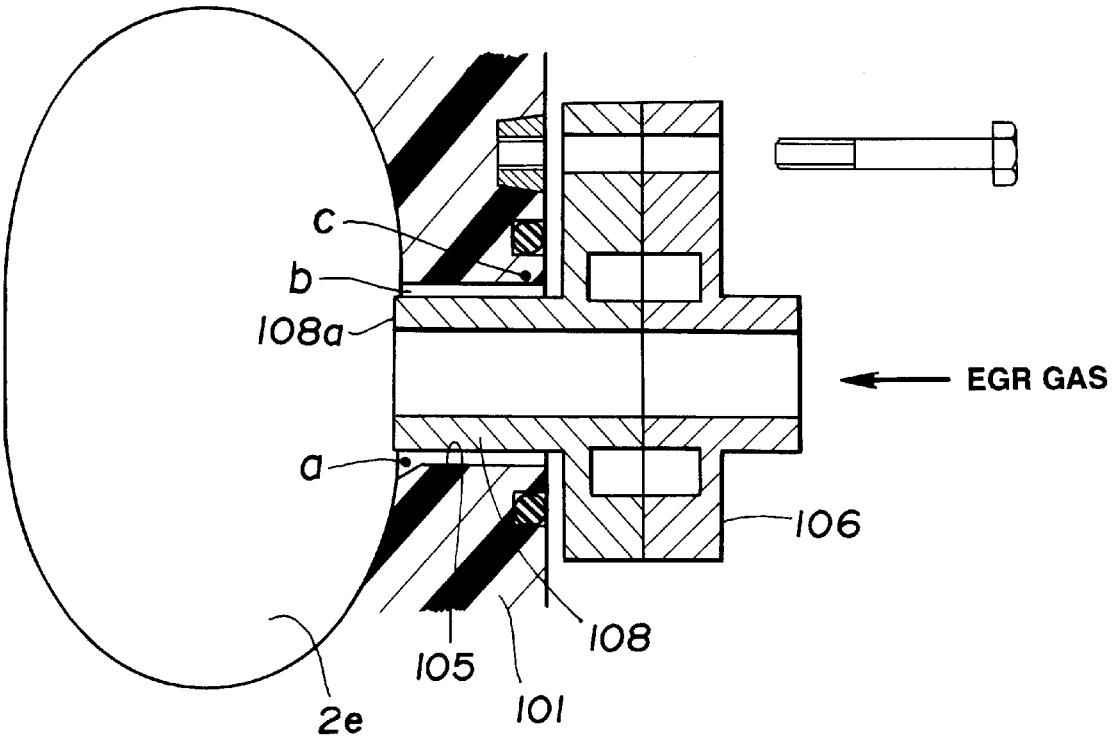
FIG. 9 is an illustration showing a test device for recognizing a cooling effect of an annular groove possessed by the second embodiment.

In order to recognize the cooling effect of the above-mentioned annular groove 60, an experiment has been carried out by the inventor. FIG. 9 shows a method of the experiment, and FIG. 10 shows the result of the experiment.

As shown in FIG. 9, in the experiment, a simple test device was provided, which comprises a plastic intake manifold 101 having a cylindrical hole 105 formed therethrough, and an EGR gas feeder 106 having a pipe portion 108 spacedly received in the cylindrical hole 105. Like in the second embodiment, the leading end 108*a* of the pipe portion 108 is slightly projected into the interior of the plastic intake manifold 101. As shown, the inner end of the cylindrical hole 105 is formed at diametrically opposed portions with a tapered part "a" and a non-tapered part "b" respectively. Denoted by reference "c" is a part near an outer end of the cylindrical hole 105. The distance between the parts "b" and "c" was about 26 mm. For the experiment, intake air was forced to flow in the intake manifold 101 and EGR gas was led into the intake manifold 101 from the pipe portion 108, and the temperature of the three parts "a", "b" and "c" was measured.

Figure 10:
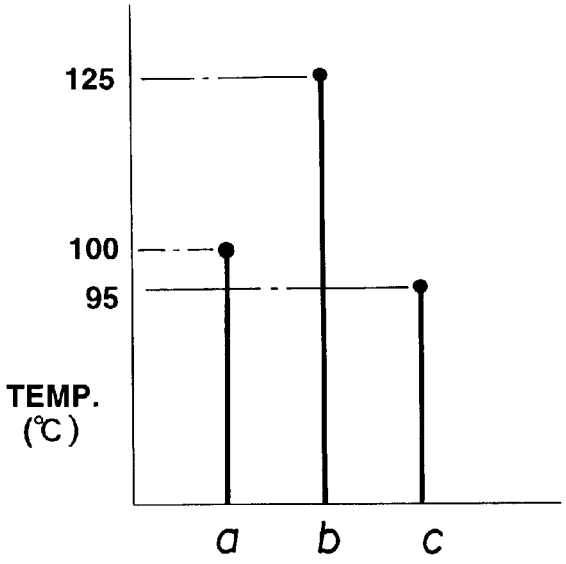
FIG. 10 is a graph showing the result of the experiment.

The result of the experiment is shown in the graph of FIG. 10. As is understood from this graph, the temperature (100° C.) of the part "a" was very low as compared with that (125° C.) of the part "b". This proves the cooling effect possessed by the annular groove 60.

What is claimed is:

1. An exhaust gas recirculation system for use with an internal combustion engine having a plastic intake passage, comprising:

a connecting base formed on said plastic intake passage, said connecting base having an exhaust gas inlet hole connected with the interior of said intake passage;

an exhaust gas recirculation valve through which a metered amount of exhaust gas produced by the engine is fed back to the interior of said plastic intake passage; and a cooling device arranged between said connecting base and said exhaust gas recirculation valve, said cooling device including mutually separated first and second passages, said first passage connecting an outlet opening of said exhaust gas recirculation valve to said exhaust gas inlet hole of said connecting base, said second passage being shaped to surround said first passage and adapted to flow therein a coolant, wherein said first passage of said cooling device includes a pipe portion which penetrates through said exhaust gas inlet hole keeping a given space between an outer wall of said pipe portion and an inner wall of said exhaust gas inlet hole, and wherein said cooling device comprises front and rear housing members which are united in such a manner that said first passage passes through both said front and rear housing members.

2. An exhaust gas recirculation system for use with an internal combustion engine having a plastic intake passage, comprising:

a connecting base formed on said plastic intake passage, said connecting base having an exhaust gas inlet hole connected with the interior of said intake passage;

an exhaust gas recirculation valve through which a metered amount of exhaust gas produced by the engine is fed back to the interior of said plastic intake passage; and a cooling device arranged between said connecting base and said exhaust gas recirculation valve, said cooling device including mutually separated first and second passages, said first passage connecting an outlet opening of said exhaust gas recirculation valve to said exhaust gas inlet hole of said connecting base, said second passage being shaped to surround said first passage and adapted to flow therein a coolant, wherein said first passage of said cooling device includes a pipe portion which penetrates through said exhaust gas inlet hole keeping a given space between an outer wall of said pipe portion and an inner wall of said exhaust gas inlet hole, and wherein said cooling device is formed with a threaded bolt hole which is surrounded by said second passage, said threaded bolt hole operatively receiving therein a threaded bolt for securing said exhaust gas recirculation valve to said cooling device.

3. An exhaust gas recirculation system as claimed in claim 2, in which said threaded bolt hole is formed with a counter bore at its open side exposed to a given surface of said cooling device to which said exhaust gas recirculation valve is connected.

4. An exhaust gas recirculation system as claimed in claim 3, in which the length of said counter bore is substantially equal to the distance from said given surface and said second passage.

5. An exhaust gas recirculation system as claimed in claim 3, in which the length of said counter bore is greater than the distance from said given surface and said second passage.

6. An exhaust gas recirculation system for use with an internal combustion engine having a plastic intake passage, comprising:

a connecting base formed on said plastic intake passage, said connecting base having an exhaust gas inlet hole connected with the interior of said intake passage;

an exhaust gas recirculation valve through which a metered amount of exhaust gas produced by the engine is fed back to the interior of said plastic intake passage; and a cooling device arranged between said connecting base and said exhaust gas recirculation valve, said cooling device including mutually separated first and second passages, said first passage connecting an outlet opening of said exhaust gas recirculation valve to said exhaust gas inlet hole of said connecting base, said second passage being shaped to surround said first passage and adapted to flow therein a coolant, wherein said first passage of said cooling device includes a pipe portion which penetrates through said exhaust gas inlet hole keeping a given space between an outer wall of said pipe portion and an inner wall of said exhaust gas inlet hole, wherein said cooling device is secured to said connecting base by means of a threaded bolt, said bolt penetrating through a through bore formed in said cooling device and engaging with a threaded bolt hole provided in said connecting base, and wherein said through bore of said cooling device has a front end exposed to a surface which is recessed from a surface to which said exhaust gas recirculation valve is connected.

7. An exhaust gas recirculation system for use with an internal combustion engine having a plastic intake passage, comprising:

a connecting base formed on said plastic intake passage, said connecting base having an exhaust gas inlet hole connected with the interior of said intake passage;

an exhaust gas recirculation valve through which a metered amount of exhaust gas produced by the engine is fed back to the interior of said plastic intake passage; and a cooling device arranged between said connecting base and said exhaust gas recirculation valve, said cooling device including mutually separated first and second passages, said first passage connecting an outlet opening of said exhaust gas recirculation valve to said exhaust gas inlet hole of said connecting base, said second passage being shaped to surround said first passage and adapted to flow therein a coolant, wherein said first passage of said cooling device includes a pipe portion which penetrates through said exhaust gas inlet hole keeping a given space between an outer wall of said pipe portion and an inner wall of said exhaust gas inlet hole, wherein said cooling device is secured to said connecting base by means of a threaded bolt, said bolt penetrating through a through bore formed in said cooling device and engaging with a threaded bolt hole provided in said connecting base, and wherein said threaded bolt hole provided in said connecting base is defined by a metal nut embedded in said connecting base, said metal nut having a trapezoidal cross section to increase an area thereof to which said cooling device contacts.

8. An exhaust gas recirculation system as claimed in claim 7, in which said connecting base is formed with a heat insulating groove in the surface to which said cooling device is connected, said heat insulating groove surrounding said exhaust gas inlet hole.

9. A cooling device for use in an exhaust gas recirculation system, comprising:

a front housing member;

a rear housing member;

a seal member; and bolts for coupling said front and rear housing members having said seal member interposed therebetween thereby to constitute a housing unit, said housing unit including mutually separated first and second passages, said first passage being adapted to pass therethrough exhaust gas for exhaust gas recirculation, said second passage being shaped to surround said first passage and adapted to flow therethrough a coolant.

* * * * *